United States Patent [19]

Dautremont, Jr.

[11] 4,128,158

[45] Dec. 5, 1978

[54] PRECISION COIN ANALYZER FOR NUMISMATIC APPLICATION

[75] Inventor: Joseph L. Dautremont, Jr., Northridge, Calif.

[73] Assignee: Coin Cop Co., Glendale, Calif.

[21] Appl. No.: 707,891

[22] Filed: Jul. 22, 1976

[51] Int. Cl.[2] ..... G07F 3/02

[52] U.S. Cl. ..... 194/100 A

[58] Field of Search ..... 194/100, 100 A, 97; 73/163; 324/34 R

[56] References Cited

U.S. PATENT DOCUMENTS

| | | | |
|---|---|---|---|
| 2,642,974 | 6/1953 | Ogle | 194/100 R |
| 3,599,771 | 8/1971 | Hinterstocker | 194/100 A |
| 3,796,295 | 3/1974 | Montolivo et al. | 194/100 A |
| 3,933,232 | 1/1976 | Searle | 194/100 A |
| 3,956,692 | 5/1976 | Weinberg | 194/100 R |

*Primary Examiner*—Stanley H. Tollberg

*Attorney, Agent, or Firm*—William J. Schneider, Jr.

[57] ABSTRACT

A precision analyzer for the testing of numismatic coins or other metallic articles is disclosed whereby the article to be tested is introduced into the field generated by the inductor of an oscillator and the change in amplitude of the oscillations resulting from the interaction of the field generated and the article to be tested is measured.

6 Claims, 3 Drawing Figures

PRECISION COIN ANALYZER FOR NUMISMATIC APPLICATION

BACKGROUND OF THE INVENTION

The testing of coins by electrical means has become increasingly important with the increased use of vending machines. In broad terms these devices seek to separate genuine coins from counterfeit coins. To constitute an economic threat to the vending machine, the counterfeit must cost less than the genuine coin it replaces.

Economic threats to vending machines would seem to be limited to simple counterfeits as metal washers or low denomination foreign coins of similar size and shape which can be economically obtained. The testing devices to fill these needs are relatively crude as suits their task.

Another purpose of coin testing is found in needs of those who purchase bullion coins. In this case a substantial economic threat is posed by a counterfeit who fabricates a gold exterior resembling a coin on a base metal disk. No collector would physically probe in the inner structure of the coin since in so doing he would destroy much of its numismatic value. Precise electrical methods are of value, since they provide data on the core material by a nondestructive test.

PURPOSE OF THE INVENTION

It is the object of the invention to provide a means of evaluating coins or other metallic articles through a nondestructive electrical test.

DESCRIPTION OF THE INVENTION

In its basic form, the invention consists of a resonant circuit 2 containing an inductor and a capacitor, together with a suitable means of standardizing the relative position of the coin to be tested within the field of the inductor, a two terminal oscillator circuit 3 which produces an oscillating voltage across the coil terminals, and a metering circuit 4 which measures the amplitude of the oscillating voltage which appears across the coil terminals.

Insertion of a coin into the electromagnetic field of the coil causes the oscillator voltage amplitude to change. The amount of change which occurs is then measured and used to classify the coin. The change in oscillator voltage amplitude is a function of the physical dimensions and electrical properties of materials which form the coin. The physical dimensions of the coin determine its inductance as an electrical circuit and the material of the coin determines its electrical resistance and hence the losses encountered when currents are induced in the coin. The relative dimensions and positions of the coin and coil determine the degree to which energy from the field of the oscillator coil is coupled into the coin and the resulting losses. The oscillator voltage amplitude is determined by the inductance of the coin as determined by its size and the resistance of the coin as determined by its constituent materials.

The fact that a coin will absorb energy from an oscillating electromagnetic field is well known and has been widely applied in coin testing. The others who have sought to employ this effect have employed substantially different mechanisms. There are several mechanisms which depend on the application of an oscillator voltage to an inductance bridge circuit wherein the coil is the inductor in an inductance measuring bridge circuit. The bridge error voltage caused by the presence of the coin is measured. There are other applications in which the coin to be tested is interposed between a transmitting coil and a receiving coil wherein the reduction in transmitted energy is measured. These methods differ from the method shown in that none of them seek to measure small changes in the amplitude of oscillations of an oscillator caused by the introduction of a coin.

Figure 2:
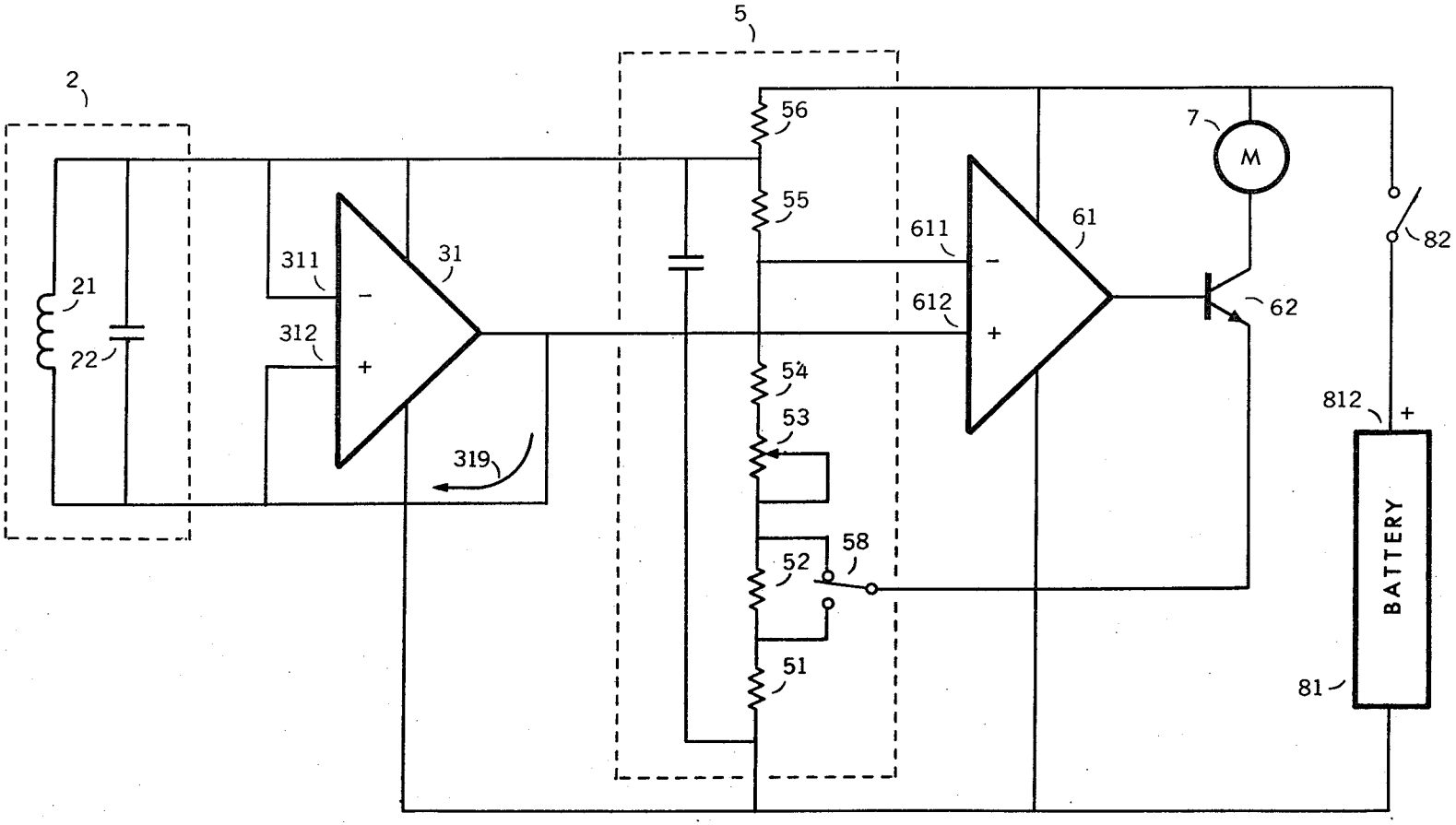
FIG. 2 is a more specific system in accordance with the invention showing the generalized elements in terms of amplifiers and passive elements.

The preferred embodiment of the invention appears in FIG. 2. The oscillator employs a parallel resonant circuit 2 consisting of inductor 21 and capacitance 22. These elements determine the frequency of oscillation. The coin to be tested is introduced into the field of the inductor 21. The resonant circuit is connected to the output terminal of the differential amplifier 31.

Figure 1:
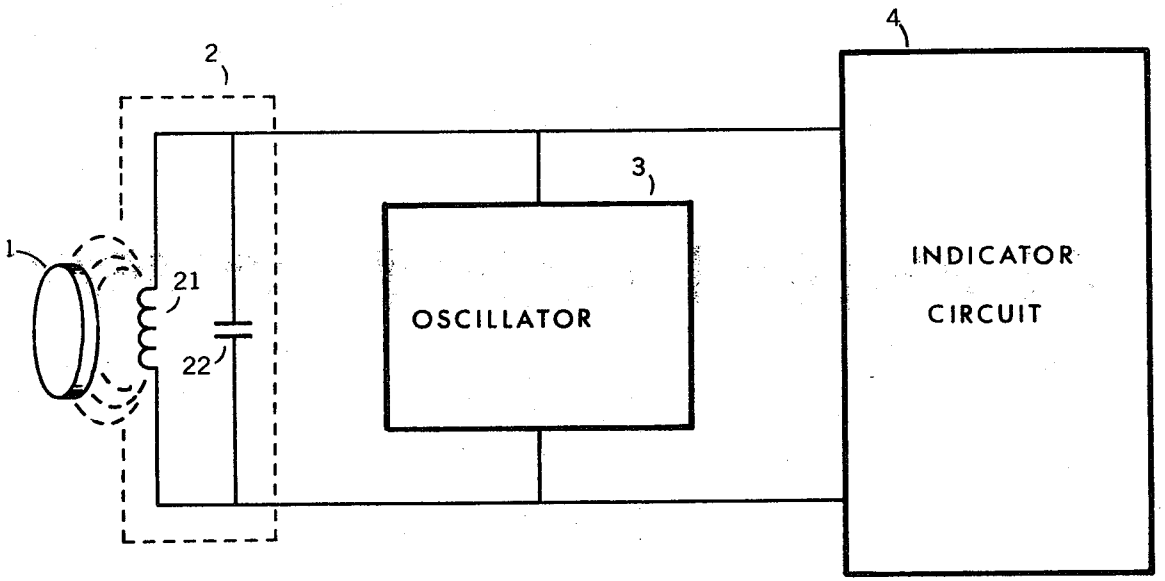
FIG. 1 is a block diagram of the generalized system in accorance with the invention for the nondestructive testing of coins.

The functional elements of the invention are shown in FIG. 1. They consist in part of a resonant circuit 2 which determines the frequency of the oscillator 3. The inductance coil 21 of the resonant circuit is electromagnetically coupled to the coin 1 to be examined. The amplitude of the oscillations is a function of the oscillator energy dissipated in the coin.

The indicator circuit 4 measures the amplitude of the oscillations by comparing it against a reference voltage from coupling network 5 and amplifing the difference in amplifier 61. The output of the amplifier (a) causes the meter 7 to deflect as a measure of the coin's properties and (b) provides a feedback into the coupling network, which modifies the amplifier reference voltage so that in the final state the meter indicates the feedback current necessary to bring the reference voltage to equivalence with the amplitude of the oscillations. Although this indicator circuit is unique in itself, the principal of negative feedback is well known to those skilled in the art for its ability to provide a precise and stable indication of the function measured.

Referring to FIG. 2 which shows the invention in more detail, the oscillator is seen to incorporate a direct coupled high gain amplifier 31. The amplifier provides an output current 319 proportional to the voltage difference between the input terminals 311 and 312. The positive gain input terminal 312 is connected to the output terminal so that when the output current flows through the parallel resonant circuit consisting of inductor 21 and capacitor 22 a voltage is generated which is fed to the positive input terminal causing a further increase in output current. The fact that an increase in voltage across the resonant circuit leads to an increase in current through the resonant circuit is the manifestation of a negative resistance. The negtive resistance of the amplifier overcomes the losses in the resonant circuit and allows oscillating currents to build up to a point where the energy lost in each style is equally supplied by the amplifier. Since a major source of losses is due to the presence of a coin placed in or near the inductor, the amplitude of the oscillations will be a measure of losses in the coin.

The voltage developed across the resonant circuit is connected to the positive gain input terminal 612 of amplifier 61. The inverting gain input terminal 611 of amplifier 61 is connected to a reference point on the coupling network. Amplifier 61 is constructed so as to respond to the difference between the peak negative excursion of the oscillator voltage and the voltage at the reference point on the coupling network. This voltage difference is amplified and applied to the base terminal 621 of transistor 62. In this configuration the transistor base current is about 2% or less of the emitter 622 so that about 98% of the emitter current flows through the collector terminal 623 and serves to deflect the meter 7 before returning through switch 82 to the positive terminal 812 of the battery 81. The emitter current returns to the negative terminal 811 of the battery through resistor 51 or the combination resistors 51 and 52.

The current 622 which flows into the coupling network is nearly equal to the meter current. The voltage drop developed in resistor 51 and 52 by the passage of the meter current is coupled to the inverting terminal 611 of the amplifier through resistors 53, 54 and 55. The resistor network is designed so that the currents required for full scale deflection of the meter, when coupled back to the amplifier terminal, are at least sufficient to compensate for the range of oscillator amplitudes encountered in coin testing. The result is that in spite of variations of circuit elements in amplifier 61 or of transistor 62, the meter deflection is accurately a measure of the oscillator amplitude.

Switch 58 directs the meter current return path through resistor 51 or through resistors 51 and 52 in series. In the former case, the total voltage drop caused by the meter current and its effectiveness in matching oscillator amplitude variations is decreased. A greater change in meter current will now be required to compensate for a given change in oscillator amplitude than would be required in the latter case. Thus switch 58 provides a simple and effective means of controlling the meter sensitivity to amplitude changes.

A further feature of the invention is found in the fact that both the amplitude of oscillations and the coupling network reference voltage at amplifier terminal 611 vary as the battery voltage varies. As a result the invention is relatively insensitive to variations in battery voltage.

Figure 3:
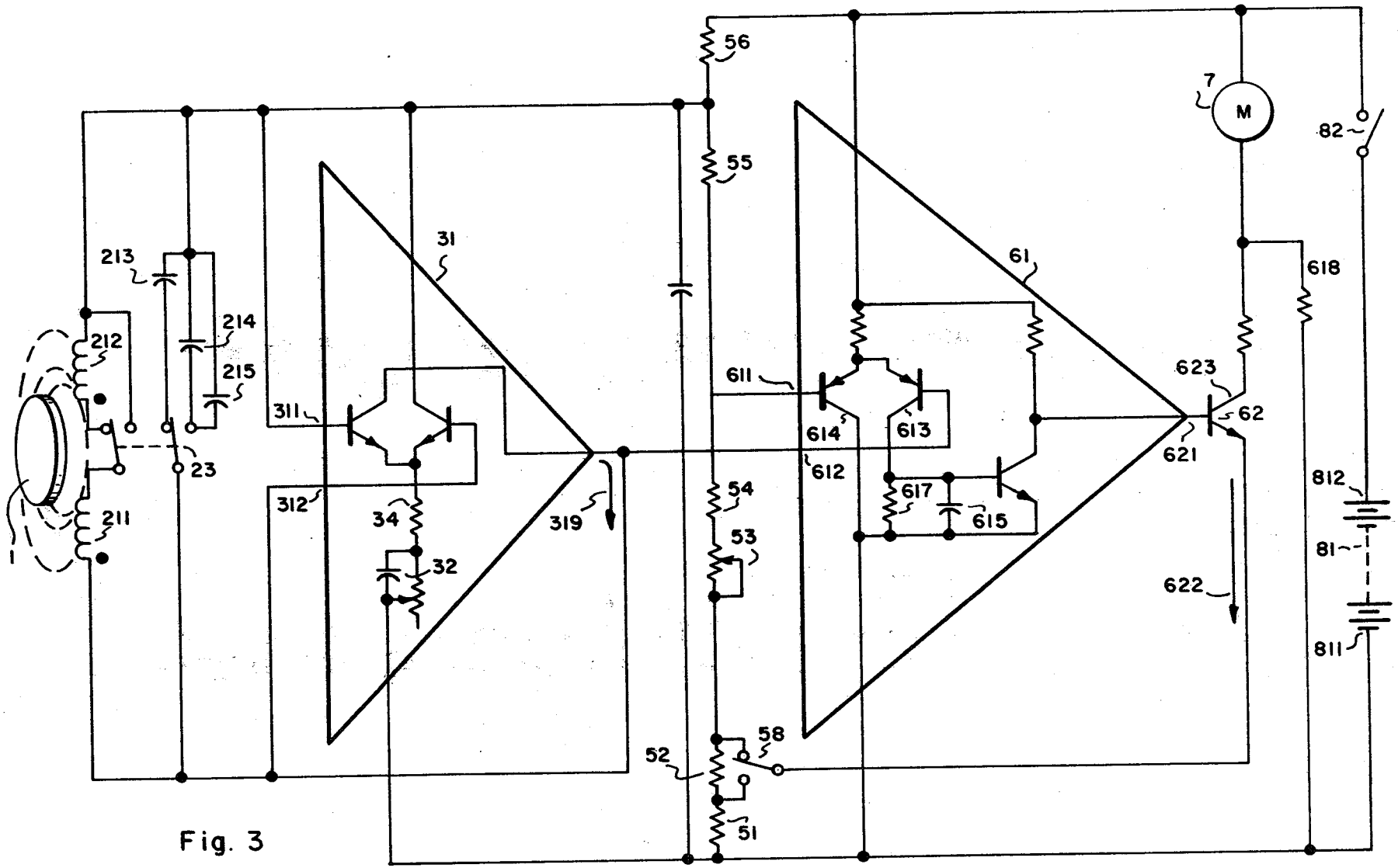
FIG. 3 is a circuit diagram in accordance with the invention wherein details of the amplifiers are shown.

The complete schematic of the preferred implementation is shown in FIG. 3. The amplifier 31 which serves as the oscillator is seen to provide an output current 319 as a function of the differential input voltage as measured between the positive gain input terminal 312 and the negative gain input terminal 311. An increasing positive voltage on terminal 312 causes the output current 319 to increase while such a voltage applied to terminal 311 would cause the output current to decrease.

The primary path of this current is through resonant circuit 2 and then to the positive terminal of the battery through the coupling network. Since there is almost no resistance in the resonant circuit, the steady state voltage at terminal 312 is nearly the same as that at terminal 311.

The circuit produces oscillating currents since the increase in the flow of any current in the impedance of the resonant circuit causes an increase in the voltage across the amplifier input terminals and a further increase in amplifier output current. The build up continues until the amplifier can no longer increase the current and the process reverses. Since some of the input current is inductively coupled into the coin being evaluated the nature of the coin will affect the reversal point and hence the amplitude of oscillations. The amplifier output current and hence the amplitude of the oscillator voltage is controlled by resistor 32 and 34. As resistor 32 is increased, the current available to the output is decreased and the amplitude of the oscillator voltage is decreased.

Resistor 32 is used in operation of this invention to set the meter deflection for a particular coin, ingot of bullion or other article. A coin of known quality is placed in the field of the inductor and the meter is set to mid-scale or other convenient deflection using resistor 32. A coin of unknown quality is then substituted. Any difference in meter deflection is an indication of a difference in coin material or size. Resistor 32 also provides a means of determining the condition of charge of the battery. If the battery is charged, advancing resistor 32 to a maximum resistance will result in at least a full scale deflection of the meter.

This invention uses an oscillator which requires only a two terminal resonant circuit. Although two terminal oscillators are known to those skilled in the art, they have not generally been adapted to coin testing although their advantages are manifold. Use of a two terminal oscillator is a substantial improvement over prior methods in simplicity and economy of construction, and in that changing frequency can be accomplished simply. In this invention, switch 23 allows inductor 212 to be added in series with inductor 211 and capacitors 214 and 215 to be substituted for capacitor 213. This switching is a simple but effective means of changing the frequency of oscillations. The ability to change the frequency of oscillation is important to coin testing. Lower frequencies penetrate more deeply in the material of the coin under test and provide a means of investigating the internal structure of the coin. Higher frequencies provide a means of investigating the characteristics of the coin near the surface of the coin. Inductors 211 and 212 are wound together to form the test inductor. The invention achieves a ratio of five to one in the frequencies determined by switch 23. The lower frequency being on the order of 100,000 Hertz and the higher on the order of 500,000 Hertz. The invention is not restricted to these frequencies or to this range of frequencies.

These frequencies are found particularly useful in testing common coins.

The voltage developed across the coil 21 is coupled to the indicator amplifier 61 terminal 612. The voltage difference between terminals 612 and 611 is amplified by the differential amplifier consisting of transistors 613 and 614, causing the current in the collector of transistor 613 to vary about the quiescent value. This current tends to charge capacitor 615 but since the collector current never reverses, it never tends to discharge the capacitor. Discharge takes place only through the base of transistor 616 or through resistor 617. The values of the elements in these paths are such as to allow only a very small discharge during one cycle of oscillation. As a result, capacitor 615 tends to charge to a steady voltage which approaches the product of the average collector current and the discharge resistance. This voltage is proportional to the difference between the negative peak of the oscillating voltage and the value of the reference steady state voltage applied by the coupling network to terminal 611. This unique feature of the indicator allows a direct comparison of the oscillator amplitude and the steady state reference voltage, and as will be shown, the precise measurement of the former by the latter.

The steady state voltage across capacitor 615 is further amplified by transistor 616 whose collector terminal is the output of the amplifier.

The indicator amplifier drives the base of transistor 62. Transistor 62 provides the unique function of controlling the current through the indicating meter 7 and the feedback current into the coupling network 5. It is a basic property of transistors that the collector current is less than the emitter current network by a factor commonly between 98% and 100%. The feedback current to the coupling network is thus essentially equal to the meter current.

As previously stated, the input to the indicator amplifier is the difference between the peak voltage developed across the inductor and the steady state voltage developed across resistor 55. The steady state component of the inductor voltage is negligible since the coil has a low resistance. The feedback current from transistor 62 decreases the current flowing through resistor 55 in proportion to the difference voltage so as to reduce the difference voltage at the input of the amplifier nearly to zero. The feedback current which is required to zero the differential input voltage is determined by the coupling network resistor 51 or resistors 51 and 52 as determined by switch 58 together with resistors 53, 54, 55 and 56. In the preferred implementation, the resistance of resistors 51 and 52 together is approximately 2½ times the resistance of resistor 51 alone. As a result, full scale deflection of the meter would be 2½ times as effective in zeroing changes of oscillator level when resistors 51 and 52 are selected as when resistor 51 alone is selected. Consequently, the sensitivity of meter current to changes in amplitude of oscillations is 2½ times as great as in the latter case than in the former case.

Switch 58 provides a means of altering the system sensitivity, a feature which adds substantially to the utility of the invention. The ratio of 2½ is not essential to the function of the invention. It could be 2 or 5 or 10 or any other reasonable ratio and in fact switch 58 could provide not 2 but 3 or more distinct values of sensitivity.

Resistor 53 is adjustable and provides a means of standardizing the performance for the units as manufactured. Resistor 618 provides a standing current in the meter to indicate that the battery switch is in the "on" position. The current through resistor 618 does not materially affect the sensitivity of the system or the feedback "zeroing".

The method and apparatus specified herein provides a unique and useful means of testing coins. The usefulness is increased because the test may be applied in a dynamic or in a static situation since it does not require movement of the coin for its operation. The invention's usefulness extends beyond its application to coins. It generally provides a means of non-destructive testing and comparison of similarly shaped metallic articles. It could be used for evaluating the inner structure of electronic components such as capacitors or conductors. It could be used for evaluating the inner structure of such simple articles as machine screws. The scope of the invention is by no means limited to coin testing. Any modifications or applications which may occur to those skilled in the art should be considered within the scope of the invention.

I claim the following:

1. A method for the static testing of coins or other metallic objects whereby oscillating currents in the coil of an oscillator are coupled first to a standard or reference article and the amplitude of oscillations is compared to a direct current derived from the current measured by the indicator, for the purpose of setting the amplitude of oscillations to a reference level; the currents are then coupled to the article to be tested and any difference in losses causes a change in amplitude of said oscillations from the reference level which is compared to the changed direct current derived from the changed current measured by the indicator.

2. An indicating method according to claim 1 wherein the differential amplifier output causes a current to flow in an indicating meter and a nearly identical current is used to develop a voltage which is compared to the amplitude of the oscillations.

3. An indicating method according to claim 2 wherein the voltage which is compared to the amplitude of oscillations is developed by the flow of said nearly identical current through resistors of a coupling network and where the number of resistors or the resistance in the path of said current can be determined by a switch, thereby controlling the sensitivity of the indicating method.

4. An indicating method according to claim 2 wherein a steady current is caused to flow in said indicating meter such that a small deflection of said meter is caused indicating that power is applied.

5. A method according to claim 2 whereby the amplitude of oscillations can be adjusted so as to allow setting of the indication said indicating device to a known level when a reference article is coupled to the currents in the oscillator coil.

6. A method according to claim 5 wherein the maximum obtainable amplitude of oscillations as indicated by said indicating method is used to determine if the battery voltage available exceeds the minimum voltage necessary to power the device.

* * * * *